US008729434B2

(12) United States Patent
Tominaga et al.

(10) Patent No.: US 8,729,434 B2
(45) Date of Patent: May 20, 2014

(54) INDUCTION COOKING DEVICE

(75) Inventors: Hiroshi Tominaga, Hyogo (JP); Kenji Watanabe, Nara (JP); Izuo Hirota, Hyogo (JP); Sadatoshi Tabuchi, Osaka (JP); Keiko Isoda, Hyogo (JP)

(73) Assignee: Panasonic Corporation, Osaka (JP)

( * ) Notice: Subject to any disclaimer, the term of this patent is extended or adjusted under 35 U.S.C. 154(b) by 888 days.

(21) Appl. No.: 12/529,248

(22) PCT Filed: Mar. 11, 2008

(86) PCT No.: PCT/JP2008/000526

§ 371 (c)(1),
(2), (4) Date: Aug. 31, 2009

(87) PCT Pub. No.: WO2008/120447

PCT Pub. Date: Oct. 9, 2008

(65) Prior Publication Data

US 2010/0051608 A1 Mar. 4, 2010

(30) Foreign Application Priority Data

Mar. 12, 2007 (JP) ..... 2007-061778
Aug. 13, 2007 (JP) ..... 2007-210759

(51) Int. Cl.
*H05B 6/00* (2006.01)

(52) U.S. Cl.
USPC ..... 219/620; 219/624; 219/627

(58) Field of Classification Search
CPC .. H05B 6/062; H05B 2213/07; H05B 6/1209; H05B 2213/05; H05B 2213/04; H05B 3/746
USPC ..... 219/497, 620–627
See application file for complete search history.

(56) References Cited

U.S. PATENT DOCUMENTS 6,169,486 B1 * 1/2001 Berkcan et al. ..... 340/584
7,102,109 B2 * 9/2006 Niiyama et al. ..... 219/627

(Continued)

FOREIGN PATENT DOCUMENTS

JP 5-21149 1/1993
JP 2002-299029 10/2002

(Continued)

OTHER PUBLICATIONS

International Preliminary Report on Patentability issued Oct. 8, 2009 in International (PCT) Application No. PCT/JP2008/000526.

(Continued)

*Primary Examiner* — H Tsai
(74) *Attorney, Agent, or Firm* — Wenderoth, Lind & Ponack, L.L.P.

(57) ABSTRACT

An induction cooking device includes a heating coil performing induction heating of a cooking container placed on a top plate, an inverter circuit supplying high frequency current to the heating coil, an infrared sensor detecting an amount of infrared light radiated from the cooking container and outputting a detection signal based on the detected amount, a temperature sensor detecting a temperature of the cooking container by thermal conduction through the top plate, and a control unit controlling an output of the inverter circuit so that the outputs of the infrared and temperature sensors do not exceed the respective control temperature. The control unit judges whether or not the infrared sensor is normally detecting the temperature of the cooking container, and when it is judged that the infrared sensor is normally detecting the temperature of the cooking container, the control unit raises the control temperature of the temperature sensor.

9 Claims, 8 Drawing Sheets

(56) References Cited

U.S. PATENT DOCUMENTS

| | | | | |
|---|---|---|---|---|
| 7,473,872 | B2 * | 1/2009 | Takimoto | 219/627 |
| 2003/0047559 | A1 | 3/2003 | Watanabe et al. | |
| 2006/0081607 | A1 * | 4/2006 | Niiyama et al. | 219/497 |

FOREIGN PATENT DOCUMENTS

| | | |
|---|---|---|
| JP | 2003-317918 | 11/2003 |
| JP | 2004-227816 | 8/2004 |
| JP | 2004-327053 | 11/2004 |
| JP | 2005-108496 | 4/2005 |
| JP | 2005-216501 | 8/2005 |
| JP | 2005-216585 | 8/2005 |

OTHER PUBLICATIONS

Supplementary European Search Report issued Aug. 8, 2011 in European Application No. EP 08 82 7475.

International Search Report issued Jun. 17, 2008 in International (PCT) Application No. PCT/JP2008/000526, filed Mar. 11, 2008.

U.S. Office Action issued Aug. 12, 2011 in U.S. Appl. No. 12/529,261.

Supplementary European Search Report issued Aug. 16, 2011 in European Application No. EP 08 72 0412.

Supplementary European Search Report issued Aug. 16, 2011 in European Application No. EP 08 76 4204.

* cited by examiner

| HEATING POWER SETTING | CONTROL TEMPERATURE OF TEMPERATURE SENSOR | |
|---|---|---|
| | CT1 | CT2 |
| 4(2000W) | 180℃ | 215℃ |
| 3(1500W) | 200℃ | 218℃ |
| 2(1000W) | 220℃ | 220℃ |
| 1(500W) | 240℃ | 240℃ |

INDUCTION COOKING DEVICE

The present application is a national stage entry of PCT/JP2008/000526, filed Mar. 11, 2008.

TECHNICAL FIELD

The present invention relates to induction cooking devices for performing induction heating of a cooking container, in particular, to an induction cooking device for controlling the heating of the cooking container while detecting the temperature of the cooking container using an infrared sensor for detecting the temperature by infrared light and a temperature sensor for detecting the temperature by thermal conduction.

BACKGROUND ART

In recent years, the induction cooking device for performing induction heating of a cooking container such as a pan with a heating coil is widely used. Such induction cooking device includes a temperature sensor for detecting heat by thermal conduction, such as a thermistor, and an infrared sensor for detecting the amount of infrared light radiated from the cooking container, and detects the temperature of the bottom of the cooking container placed on a top plate. Patent document 1 discloses an induction cooking device for controlling the power amount to supply to the heating coil by the detected temperature of the cooking container outputted from both the temperature sensor and the infrared sensor. The induction cooking device ensures safety when the infrared sensor is not operating properly or when an accurate temperature cannot be detected by the influence of disturbance light, by using both the outputs of the temperature sensor and the infrared sensor. The induction cooking device has a function of automatically boiling water or rice, and judges that the water is boiling if a temperature difference of the detected temperature within a predetermined time is small or determines that the rice-boiling is completed when the detected temperature reaches a control temperature (e.g., 130° C.), and stops the heating.

Patent document 1: JP-A-2005-216501

DISCLOSURE OF INVENTION

Problems to be Solved by the Invention

The infrared sensor detects the infrared light radiated from the cooking container and thus the heat responsiveness is satisfactory, whereas the temperature sensor detects the temperature of the cooking container by thermal conduction through the top plate and thus the heat responsiveness is not satisfactory. Thus, when heat cooking at high temperature such as a case of heating food including stir-fried food, the control temperature of the temperature sensor is set to a value lower than the control temperature of the infrared sensor to prevent red-heat or oil firing of the cooking container. When cooking with high heating power at a high temperature such as a case of heat cooking of stir-fried food and the like, the heating control is desirably performed based on the infrared sensor having satisfactory responsiveness.

However, when performing the heating control based on the output of both the temperature sensor and the infrared sensor as with the conventional induction cooking device, the temperature detected by the temperature sensor reaches the control temperature of the temperature sensor before the temperature detected by the infrared sensor reaches the control temperature of the infrared sensor at the time of high temperature, and the power supply to the heating coil is stopped or suppressed based on the detected temperature of the temperature sensor. Thus, at the time of high temperature, the heat cooking cannot be performed with high heating power based on the infrared sensor.

In view of solving the above problems, the present invention aims to provide an induction cooking device that achieves high heating power at the time of high temperature cooking while ensuring safety.

Means for Solving the Problem

An induction cooking device according to the present invention includes: a top plate; a heating coil operable to perform induction heating of a cooking container placed on the top plate; an inverter circuit operable to supply high frequency current to the heating coil; an infrared sensor that is provided on a lower side of the top plate to detect an amount of infrared light radiated from the cooking container and output a detection signal based on the amount of the infrared light; a temperature sensor operable to detect a temperature of the cooking container by thermal conduction through the top plate; and a control unit operable to control an output of the inverter circuit such that the temperature of the cooking container detected by the infrared sensor does not exceed a control temperature of the infrared sensor and the temperature of the cooking container detected by the temperature sensor does not exceed a control temperature of the temperature sensor, wherein the control unit judges whether or not the infrared sensor is normally detecting the temperature of the cooking container based on the output of the infrared sensor and, when it is judged that the infrared sensor is normally detecting the temperature of the cooking container, the control unit changes the control temperature of the temperature sensor to a higher temperature compared to when it is judged that the infrared sensor is not normally detecting the temperature of the cooking container.

If the infrared sensor is normally detecting the temperature of the cooking container, the control unit can control the inverter circuit based on the output of the infrared sensor having excellent responsiveness with respect to the temperature change of the cooking container without being influenced by the output of the temperature sensor having inferior responsiveness with respect to the temperature change of the cooking container by changing the control temperature of the temperature sensor to a higher temperature. Thus, cooking can be performed with high heating power even at the time of high temperature such as in a case of heat cooking such as stir-frying. If the infrared sensor cannot normally detect the temperature of the cooking container, overshoot can be suppressed and the inverter circuit can be safely controlled based on the output of the temperature sensor by maintaining the control temperature of the temperature sensor at the initial value set to a low temperature.

The induction cooking device may further include a timing unit operable to count a time from when it is judged that the output of the infrared sensor is normally detecting the temperature of the cooking container, wherein the control unit may again judge whether or not the output of the infrared sensor is normally detecting the temperature of the cooking container after a time longer than or equal to a predetermined time has elapsed from when it is judged that the infrared sensor is normally detecting the temperature of the cooking container, and when it is judged that the infrared sensor is normally detecting the temperature of the cooking container, the control unit may change the control temperature of the temperature sensor to a higher temperature.

For instance, when stir-frying a food, the disturbance light from the periphery reaches the infrared sensor when the pan is momentarily lifted, and the infrared sensor may temporarily output a signal. In such a case, the control temperature of the temperature sensor can be controlled not to change unintentionally a higher temperature. The temperature suppression control of the cooking container by the infrared sensor is thus less likely to be subjected to the disturbance light, and high heating power cooking can be safely achieved.

The control unit may return the control temperature of the temperature sensor to an original temperature at a predetermined timing after changing the control temperature of the temperature sensor to a higher temperature.

Therefore, the control temperature of the temperature sensor can be returned to an original temperature at any timing as necessary, such as a timing at which a situation where the infrared sensor is not appropriately detecting the temperature of the cooking container is presumed after raising the control temperature of the temperature sensor, and thus safety is enhanced.

The predetermined timing may be at a time when it is judged that the infrared sensor is not normally detecting the temperature of the cooking container based on the output of the infrared sensor after changing the control temperature of the temperature sensor to a higher temperature. Further, the predetermined timing may be a time after a predetermined time has elapsed from when it is judged that the infrared sensor is not normally detecting the temperature of the cooking container based on the output of the infrared sensor after changing the control temperature of the temperature sensor to a higher temperature.

Therefore, the control temperature of the temperature sensor can be returned to an original temperature when the infrared sensor is not normally detecting the temperature of the cooking container after raising the control temperature of the temperature sensor, and thus safety is enhanced.

The predetermined timing may be a time after the elapse of a predetermined time or more from when changing the control temperature of the temperature sensor to a higher temperature.

Therefore, the safety is enhanced if the control temperature of the temperature sensor is returned to an original temperature after longer than or equal to a predetermined time has elapsed after the control temperature of the temperature sensor is raised. For instance, when the cooking container is moved and the disturbance light reaches the infrared sensor after raising the control temperature of the temperature sensor, the infrared sensor cannot normally detect the temperature of the cooking container. Thus, the control temperature of the temperature sensor is automatically returned to an original temperature after a predetermined time has elapsed after raising the control temperature of the temperature sensor, so that the inverter circuit can be safely controlled based on the output of the temperature sensor even at the time of high temperature.

The control unit may judge that the infrared sensor is normally detecting the temperature of the cooking container when the output of the infrared sensor is within a predetermined range.

Thus, the normal detection of the temperature of the cooking container by the infrared sensor can be easily determined.

The infrared sensor may include a photodiode made of silicon as an infrared detection element, and the control unit may judge that the infrared sensor is normally detecting the temperature of the cooking container when an increased amount of the output of the infrared sensor with respect to the output of the infrared sensor at the time of start of heating is within a predetermined range.

Even if the cooking container is not at a high temperature, the output value of the infrared sensor becomes large if the disturbance light from the periphery is reaching the infrared sensor. The infrared sensor includes a photodiode made of silicon as the infrared detection element, and thus the output starts at about 250° C., and the output value exponentially increases. Therefore, by detecting that the increased amount of the output of the infrared sensor is within a predetermined range, it can be recognized that the infrared sensor operates at about 300° C. irrespective of high and low of the temperature of the cooking container at the time of the start of heating of the infrared sensor. According to such a configuration, normal detection of the temperature of the cooking container by the infrared sensor can be easily and accurately determined.

When a plurality of set values are provided according to the magnitude of the output of the inverter circuit for the control temperature of the temperature sensor, the control unit may change only the set value of the control temperature of the temperature sensor corresponding to the output of the inverter circuit of greater than or equal to a predetermined value based on the judgment on whether or not the infrared sensor is normally detecting the temperature of the cooking container.

The control temperature of the temperature sensor for high heating power setting is preferably set to a low value compared to the control temperature of the temperature sensor for low heating power setting to prevent red-heat and oil firing of the cooking container. In such a case, the control temperature of the temperature sensor for high heating power setting is changed to a high value when the infrared sensor is normal, so that when the temperature difference between the sensor temperature and the cooking container becomes small, in particular, the drawback does not occur which the temperature reaches the lowered control temperature of the temperature sensor and high temperature cooking cannot be carried out, and cooking can be carried out while controlling the temperature of the cooking container at a high temperature and high heating power with the infrared sensor of satisfactory responsiveness.

Effects of the Invention

The induction cooking device of the present invention includes both the infrared sensor and the temperature sensor, and achieves high heating power at the time of high temperature cooking while ensuring safety by changing the control temperature of the temperature sensor to a high value when judged that the infrared sensor is normally detecting the temperature of the cooking container.

DESCRIPTION OF REFERENCE NUMERALS

Figure 1:
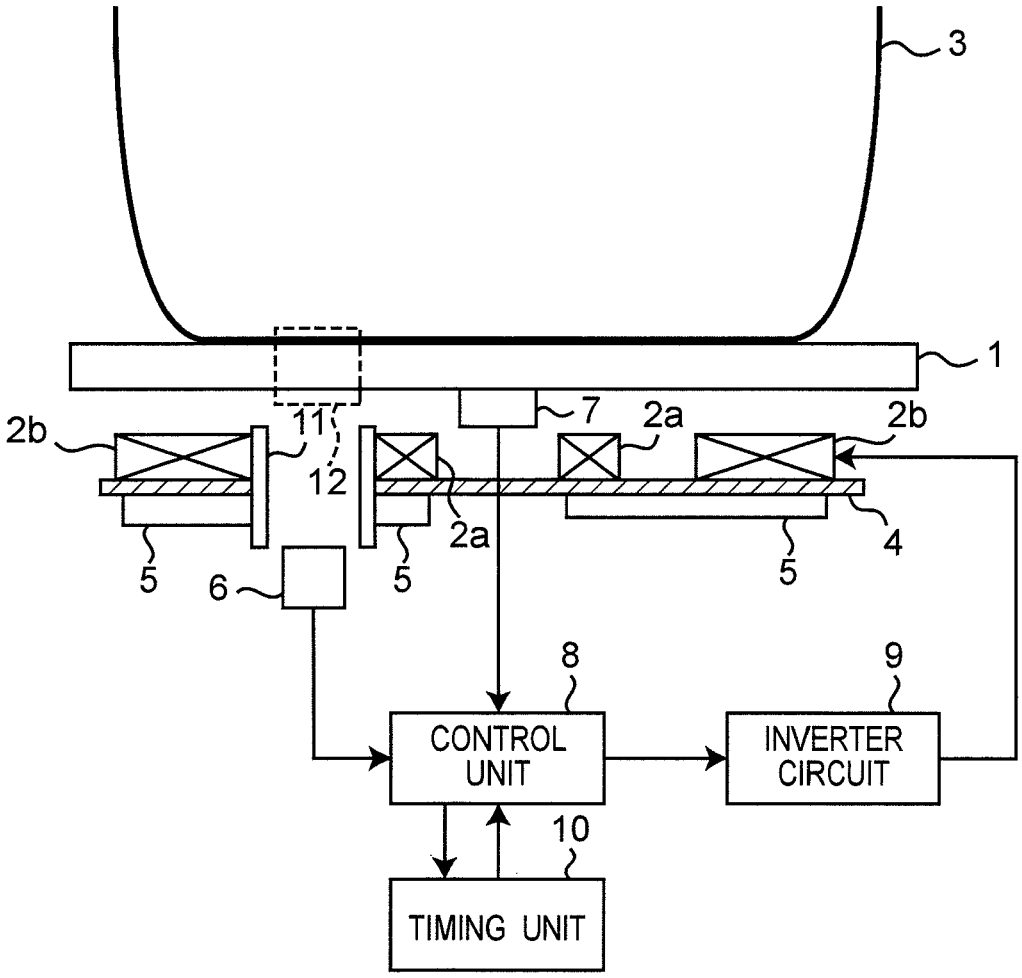
FIG. 1 shows a configuration of an induction cooking device of an embodiment of the present invention.

1 top plate
2*a* inner coil
2*b* outer coil
3 cooking container
4 heating coil supporting board
5 ferrite
6 infrared sensor
7 temperature sensor
8 control unit
9 inverter circuit
10 timing unit
11 light guiding tube

BEST MODE FOR CARRYING OUT THE INVENTION

Embodiments of the present invention will be described below with reference to the drawings.

[1.1] Configuration of Induction Cooking Device

FIG. 1 shows a configuration of an induction cooking device of an embodiment of the present invention. The induction cooking device of the present embodiment includes a top plate 1 on which a cooking container 3 is placed, and a heating coil that is provided on the lower side of the top plate 1 to perform induction heating of the cooking container 3. In the present embodiment, the heating coil has a division-wound configuration including an inner coil 2*a* and an outer coil 2*b*. The inner coil 2*a* and the outer coil 2*b* are collectively referred to as the heating coil 2 below. The cooking container 3 is placed on the upper surface of the top plate 1 at a position corresponding to the heating coil 2. The heating coil 2 is placed on a heating coil supporting board 4 provided on the lower side of the top plate 1. A ferrite 5 for concentrating the magnetic flux to the back surface side of the heating coil 2 to a portion in the vicinity of the heating coil 2 is provided at the lower surface of the heating coil supporting board 4.

The temperature sensor 7 is provided on the upper side on the inner side of the inner coil 2*a* so as to contact the lower surface of the top plate 1. The temperature sensor 7 is configured by a heat sensitive element such as a thermistor. The temperature sensor 7 receives heat from the back surface of the top plate 1 by thermal conduction to detect the temperature of the bottom surface of the cooking container 3 and outputs the detection signal to a control unit 8.

At the top plate 1, a portion 12 facing a space between the inner coil 2*a* and the outer coil 2*b* is formed of a material capable of transmitting the infrared light as an infrared light incident region. A light guiding tube 11 of a tubular shape is provided between the inner coil 2*a* and the outer coil 2*b* at the lower side of the infrared light incident region. The infrared sensor 6 is provided on the lower side of the light guiding tube 11. The infrared light based on the bottom surface temperature of the cooking container 3 radiated from the bottom surface of the cooking container 3 enters from the infrared light incident region provided in the top plate 1, and is received by the infrared sensor 6 through the interior of the light guiding tube 11. The infrared sensor 6 detects the received infrared light, and outputs the detection signal based on the detected amount of infrared light.

An inverter circuit 9 for supplying high frequency current to the heating coil 2 to control the power amount to the heating coil 2 and a control unit 8 for controlling the output of the inverter circuit 9 are arranged at the lower side of the heating coil 2. The control unit 8 controls the output of the inverter circuit 9 based on both the output of the temperature sensor 7 and the output of the infrared sensor 6. Specifically, the control unit 8 controls the switching element of the inverter circuit 9 to control the power supply to the heating coil 2 so that the bottom surface temperature of the cooking container 3 based on the amount of infrared light detected by the infrared sensor 6 does not exceed the control temperature of the infrared sensor 6 and so that the bottom surface temperature of the cooking container 3 detected by the temperature sensor 7 does not exceed the control temperature of the temperature sensor 7. In other words, when either the infrared sensor 6 or the temperature sensor 7 reaches the respective control temperature, the power supply to the heating coil 2 is stopped or suppressed. Since the temperature sensor 7 does not have satisfactory heat responsiveness, in controlling the maximum reachable temperature of the bottom surface of the cooking container 3 due to overshoot to the same temperature as with the infrared sensor 7 when the power supply to the heating coil 2 is large (e.g., 2 kW) at the time of the start of heating, the control temperature of the temperature sensor 7 (CT1 of FIG. 3B) is set to a temperature lower than or equal to the control temperature of the infrared sensor 6. In the present embodiment, when the infrared sensor 6 normally detects the temperature of the cooking container, the control temperature of the infrared sensor 6 corresponds to the signal level of the infrared sensor 6 at a point where the bottom surface temperature of the cooking container 3 detected by the infrared sensor 6 is between about 290 and 330° C., where the control temperature CT1 of the temperature sensor 7 is about 180° C.

The induction cooking device of the present embodiment further includes a timing unit 10 that starts counting time in response to a signal from the control unit 10 when the signal level of the detection signal of the infrared sensor 6 reaches a first predetermined value V. The count time counted by the timing unit 10 is transmitted to the control unit 8.

Figure 2:
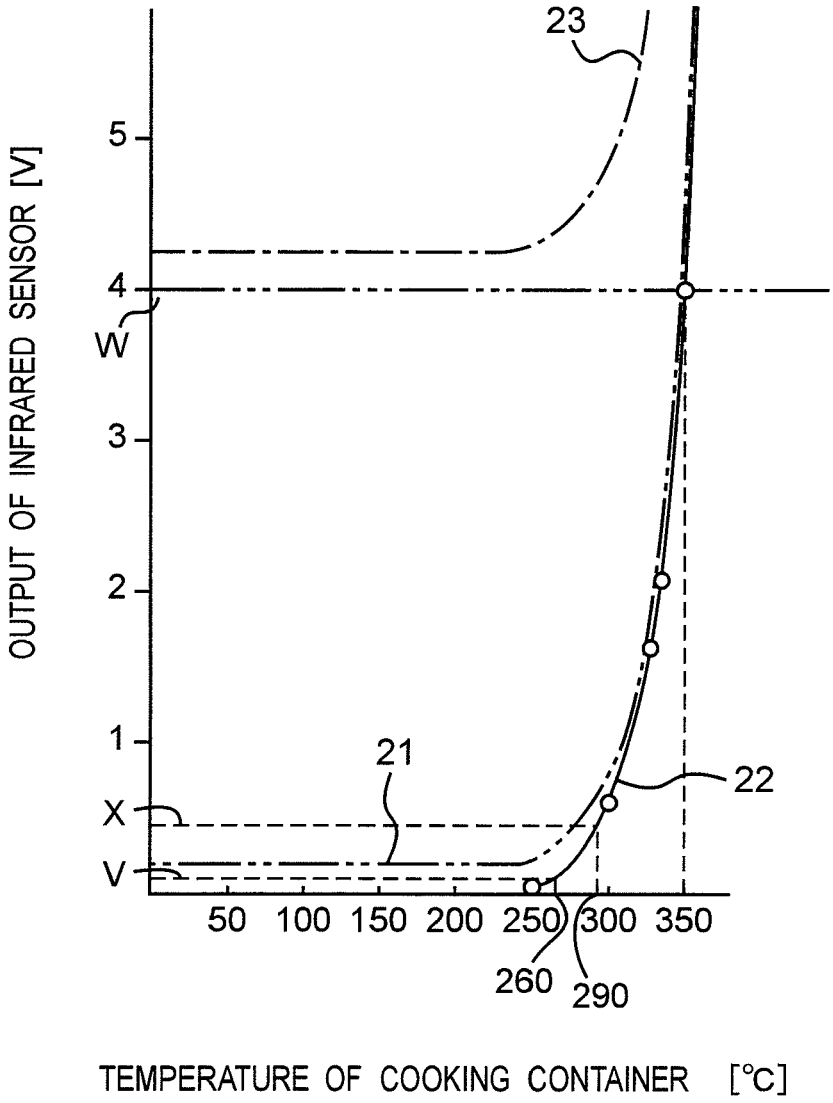
FIG. 2 is a characteristics diagram of the output of an infrared sensor of the embodiment of the present invention.

The infrared sensor 6 of the present embodiment includes a light receiving element configured by a silicon photodiode for detecting the infrared light radiated from the cooking container 3, and outputs a detection signal based on the received amount of infrared light. FIG. 2 shows the characteristics of a detection signal outputted by the infrared sensor 6. A detection signal 21 shows the characteristics in a case that relatively-weak disturbance light enters the infrared sensor 10, a detection signal 22 shows the characteristics in a case that the infrared sensor 6 is normally operating, and a detection signal 23 shows the characteristics in a case that strong disturbance light such as solar light is received. When operating normally, the infrared sensor 6 outputs the detection signal 22 when the bottom surface temperature of the cooking container 3 is higher than or equal to about 250° C. and does not output the detection signal 22 when the temperature is lower than about 250° C. "Not output the detection signal" in this case includes not only not-outputting a detection signal at all but also not-substantially-outputting a detection signal, that is, outputting such a weak detection signal that the control unit 8 cannot substantially read the change in temperature of the bottom surface of the cooking container 3 based on the change in magnitude of the detection signal.

The control unit 8 judges whether or not the infrared sensor 6 is normally detecting the temperature of the cooking container based on whether or not the signal level of the detection signal outputted by the infrared sensor 6 is within a predetermined range (greater than or equal to a first predetermined value V and smaller than or equal to a second predetermined value W). In the present embodiment, in the case of the detection signal 22 in which the infrared sensor 6 is no/dually detecting the temperature of the cooking device, the first predetermined value V corresponds to the signal level of the infrared sensor 6 at a time when the bottom surface temperature of the cooking container 3 detected by the infrared sensor 6 is about 260° C., and the second predetermined value W corresponds to the signal level of the infrared sensor 6 at a time when the bottom surface temperature of the cooking container 3 detected by the infrared sensor 6 is about 350° C.

Figures 3A, 3B:
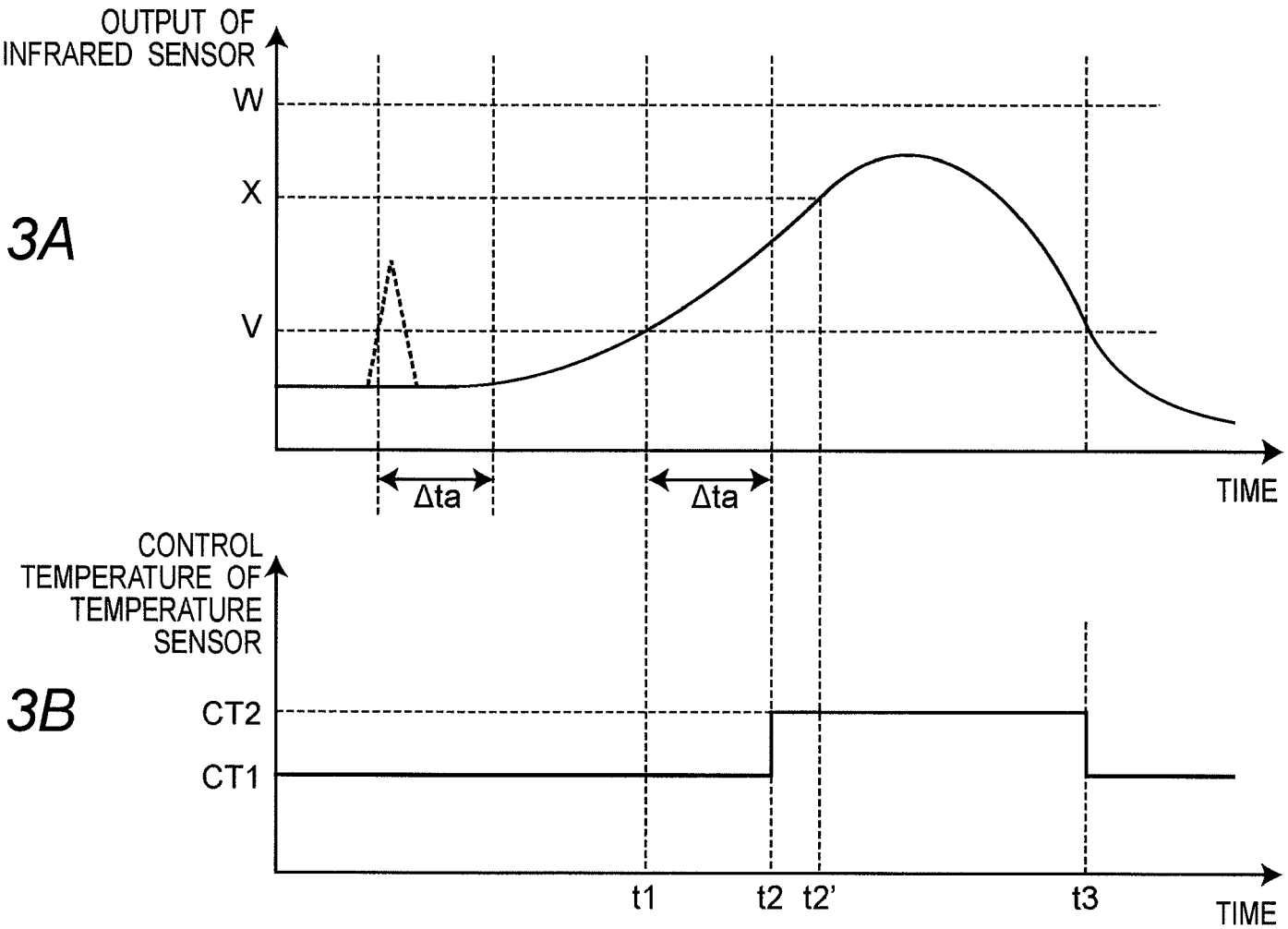
FIGS. 3A and 3B are diagrams showing a relationship between the output of the infrared sensor and the control temperature of a temperature sensor of the embodiment of the present invention.

[1.2] Control Temperature of Temperature Sensor Based on Output of Infrared Sensor FIGS. 3A and 3B show a relationship between the output of the infrared sensor 6 and the control temperature of the temperature sensor 7 after the start of heating, and the horizontal axis in FIGS. 3A and 3B shows the elapsed time. The control unit 8 judges that the infrared sensor 6 is normally detecting the temperature of the cooking container 3 when the signal level of the detection signal outputted by the infrared sensor 6 is within a predetermined range such as when exceeding the first predetermined value V after the start of heating, the control unit 8 causes the timing unit 10 to start timing (time t1) and to count the time in which the output of the infrared sensor 6 is exceeding the first predetermined value V. When the counted time from when the output of the infrared sensor 6 exceeds the first predetermine value V reaches a time longer than or equal to a first predetermined time Δta (e.g., 3 seconds), the control unit 8 judges that the infrared sensor 6 is normally detecting the temperature of the cooking container 3, and changes the control temperature of the temperature sensor 7 from a set value CT1 to a set value CT2 (time t2). When the temperature of the cooking device 3 further rises and the output of the infrared sensor 6 reaches a third predetermined value X corresponding to the control temperature of the infrared sensor 6, the control unit 8 stops or reduces the heating output of the heating coil 2 so that the output of the infrared sensor 6 does not exceed the third predetermined value X (time t2'). In the present embodiment, the bottom surface temperature (specifically, temperature of the portion measured by the infrared sensor 6) of the cooking container 3 corresponding to the third predetermine value X is about 290° C. The bottom surface temperature of the cooking container 3 corresponding to the third predetermined value X is hereinafter referred to as "control temperature of infrared sensor 6". The set value CT1 of the control temperature of the temperature sensor 7 is a value set as an initial value at the time when the power of the induction cooking device is turned ON, and a such sufficiently low temperature that the maximum reachable temperature at the time of overshoot of the bottom surface of the cooking container 3 can prevent red-heat and oil firing of the cooking container 3 by the temperature sensor 7 in the case of heating at the set heating output value of the heating coil 2. In the present embodiment, the CT1 is about 180° C. The set value CT2 is a temperature higher than the set value CT1 and is a such high temperature that the control unit 8 cannot perform the reducing operation of the heating output based on the detection signal of the temperature sensor 7 when the control unit 8 is normally performing the control operation of the cooking container 3 by the detection output of the infrared sensor 6 in normal cooking such as stir-frying vegetables. The CT2 is about 215° C. in the present embodiment.

The infrared sensor 6 is subject to the influence of disturbance light, and thus the output of the infrared sensor 6 changes based not only on the bottom surface temperature of the cooking container 3 but also based on the amount of infrared light by the disturbance light. For instance, when the cooking container 3 is temporarily moved during cooking such as stir-frying and the disturbance light reaches the infrared sensor 6 through the infrared light incident region of the top plate 1, the output of the infrared sensor 6 sometimes exceeds a predetermined value V. The control unit 8 judges that the detection signal exceeding the predetermined value V is due to the influence of the disturbance light when the counted time of the timing unit 10 is smaller than the first predetermined time Δta, and does not change the control temperature of the temperature sensor 7.

When the output of the infrared sensor 6 returns to a value smaller than the predetermined value V, the control unit 8 returns the set value of the control temperature of the temperature sensor 7 from CT2 to CT1 (time t3).

Figures 4A, 4B:
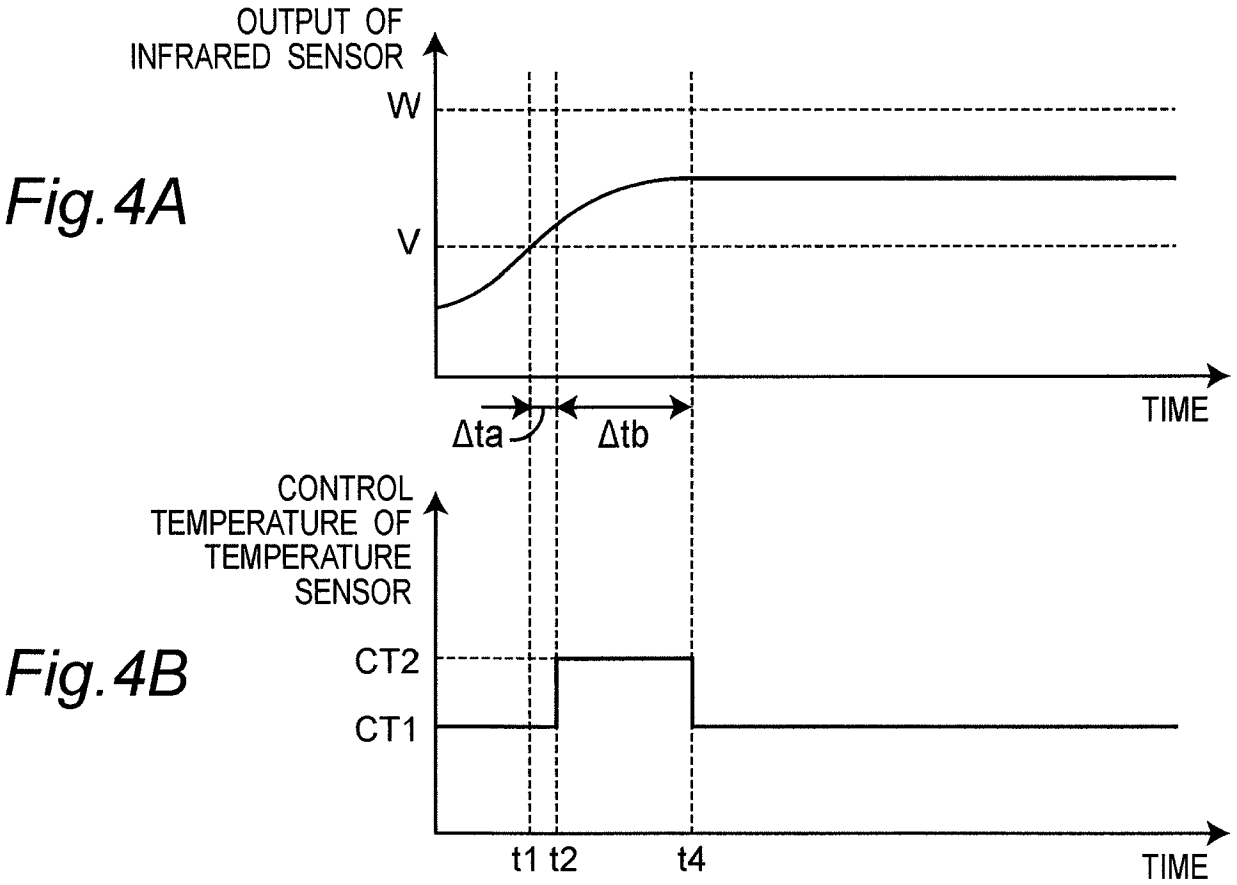
FIGS. 4A and 4B are other diagrams showing a relationship between the output of the infrared sensor and the control temperature of the temperature sensor of the embodiment of the present invention.

FIGS. 4A and 4B show a relationship between the output of the infrared sensor 6 and the control temperature of the temperature sensor 7 with the elapsed time on the horizontal axis. The control unit 8 returns the control temperature of the temperature sensor 7 (time t4) irrespective of the signal level of the detection signal outputted from the infrared sensor 6 when the counted time by the timing unit 10 from when the control temperature of the temperature sensor 7 is changed from the set value CT1 to the set value CT2 reaches the second predetermined time Δtb (e.g., 10 minutes).

[1.3] Operation of Induction Cooking Device

Figure 5:
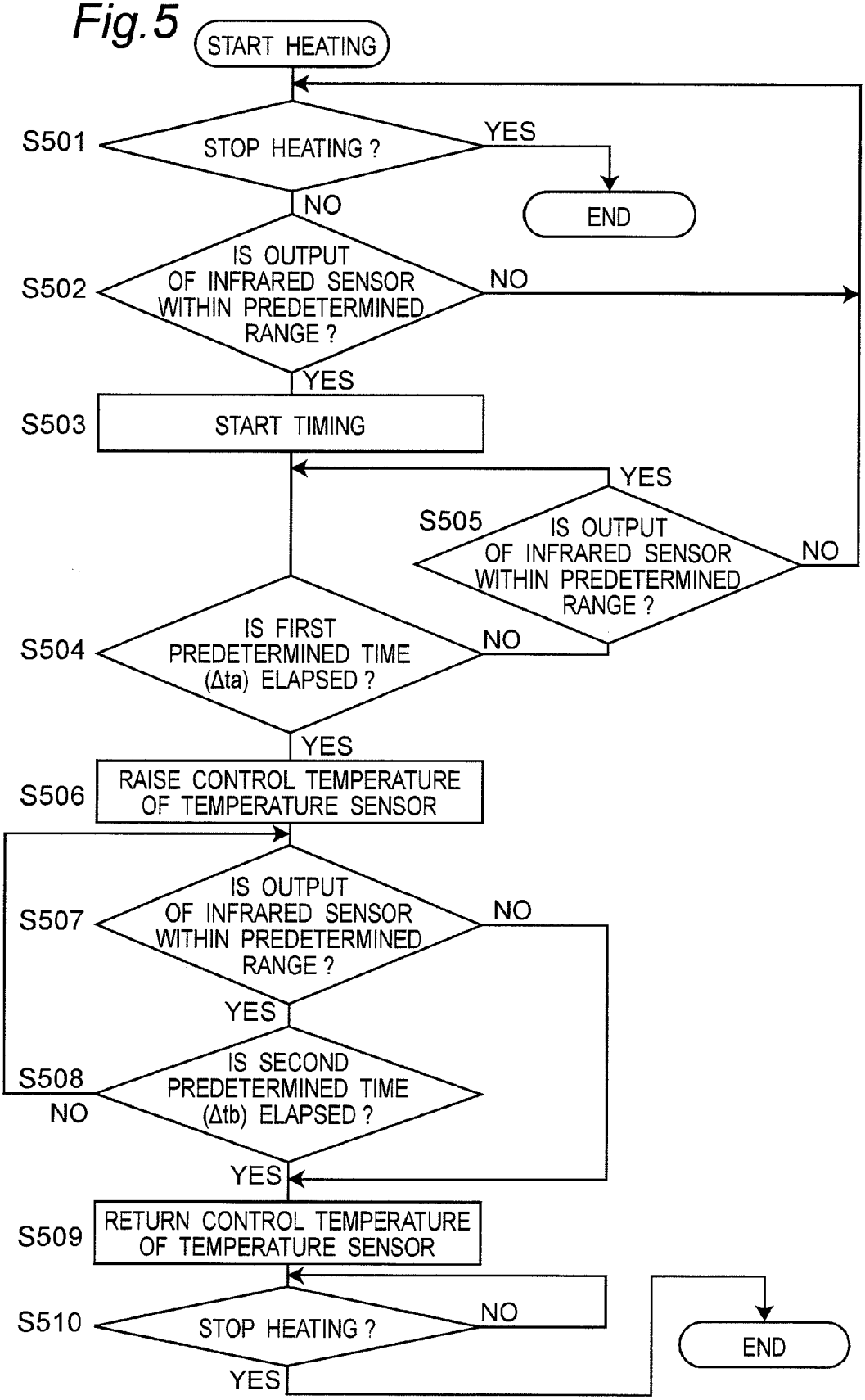
FIG. 5 is a flowchart showing the operation of the induction cooking device of the embodiment of the present invention.

The operation of the induction cooking device of the present embodiment configured as above will now be described using FIG. 5. FIG. 5 is a flowchart showing the operation related to the heating control of the induction cooking device of the present embodiment.

When start of heating is instructed by the user, the inverter circuit 9 starts to supply high frequency current to the heating coil 2. The heating of the cooking container 3 is thus started. As shown in FIG. 2, since the infrared sensor 6 does not output a detection signal when the bottom surface temperature of the cooking container 3 is low, the control unit 8 controls the inverter circuit 9 based on the output of the temperature sensor 7 until the infrared sensor 6 starts to output a detection signal. The infrared sensor 6 starts to output the detection signal when the bottom surface temperature of the cooking container reaches about 250° C. The control unit 8 controls the inverter circuit 9 such that the bottom surface temperature of the cooking container 3 detected by the infrared sensor 6 does not exceed the control temperature X of the infrared sensor 6 and the bottom surface temperature of the cooking container 3 detected by the temperature sensor 7 does not exceed the control temperature CT1 of the temperature sensor 7.

The control unit 8 judges whether or not stop of heating is instructed by the user (S501). When the stop of heating is instructed, the control unit 8 stops the heating of the cooking container 3.

When the stop of heating is not instructed, the control unit 8 judges whether or not the infrared sensor 6 is normally detecting the temperature of the cooking container, that is, whether or not the signal level of the detection signal outputted from the infrared sensor 6 is within a predetermined range (S502). The control unit 8 judges that the infrared sensor 6 is normally detecting the temperature of the cooking container 3 when the signal level of the detection signal is within the predetermined range, for example, when the signal level of the detection signal exceeds a predetermined value V at the time of starting heating, and the control unit 8 controls the timing unit 10 to start timing (S503). The control unit 8 judges whether or not the counted time of the timing unit 10 is longer than or equal to a first predetermined time Δta (S504). If the counted time has not reached to the first predetermined time Δta, it is judged whether or not the signal level of the detection signal outputted from the infrared sensor 6 is within a predetermined range (S505). The processing returns to step S504 if the signal level of the detection signal is within the predetermined range, and the processing returns to step S501 if the signal level of the detection signal is not within the predetermined range. The control unit 8 judges that the output of the infrared sensor 6 exceeding the predetermined value V is due to the rise in temperature of the cooking container 3 when the counted time reaches the first predetermined time Δta, and raises the control temperature of the temperature sensor 7 (S506).

The control unit 8 judges whether or not the signal level of the detection signal outputted from the infrared sensor 6 is within the predetermined range (S507), where if the signal level of the detection signal is not within the predetermined range, e.g., is returned to a level smaller than the predetermined value V, the control unit 8 returns the control temperature of the temperature sensor 7 immediately or after a predetermined time from when the output is returned to a level smaller than the predetermined value V (S509). If the signal level of the detection signal is within the predetermined range, it is judged whether or not a value obtained by subtracting the first predetermined time Δta from the counted time after the signal level of the detection signal is within the predetermined range, that is, the time after the control temperature of the temperature sensor 7 is raised has passed a second predetermined time Δtb (S508). If the second predetermined time Δtb has elapsed, the control temperature of the temperature sensor 7 is returned (S509). If the second predetermined time Δtb has not elapsed, the processing returns to step S507. After returning the control temperature of the temperature sensor 7, it is judged whether or not an instruction to stop the heating is inputted (S510), and the heating is continued while maintaining the control temperature of the temperature sensor 7 at the set value CT1 until the instruction to stop the heating is inputted.

Instead of the judgment of "whether or not the output of the infrared sensor is within the predetermined range" in step S507, judgment on "whether or not a state in which the output of the infrared sensor is not within the predetermined range is continued for a third predetermined time (e.g., five seconds)" may be performed, and the processing may proceed to step S509 if the state in which the output of the infrared sensor is not within the predetermined range is continued for the third predetermined time (e.g., five seconds). The possibility of returning the control temperature of the temperature sensor 7 and stopping the heating operation or suppressing the heating output with the control based on the temperature sensor 7 can be reduced if, for example, the state in which the output of the infrared sensor 6 is not within the predetermined range lasts for a short period of time. The usability is thus enhanced. Similar effects are obtained with checking if the output of the infrared sensor 6 is not within the predetermined range and then again checking the same after a predetermined time as a transitioning condition to step S509.

[1.4] Conclusion

Thus, the induction cooking device of the present embodiment controls the timing unit 10 to start timing when the signal level of the detection signal outputted from the infrared sensor 6 reaches a level within the predetermined range. Furthermore, judgment is made that the output of the infrared sensor 6 within the predetermined range is due to the temperature rise of the cooking container 3 and that the infrared sensor 6 is normally detecting the temperature of the cooking container 3 when the counted time by the timing unit 10 from when the output of the infrared sensor 6 has reached a level within the predetermined range reaches the first predetermined time Δta, and the set value of the control temperature of the temperature sensor 7 is set higher than when it is not judged that the infrared sensor 6 is normally detecting the temperature of the cooking container. Therefore, if the temperature difference between the temperature sensor 7 and the cooking container 3 is small when the top plate 1 is at a high temperature, the detected temperature by the temperature sensor 7 can be prevented from reaching the control temperature of the temperature sensor 7 before the detected temperature by the infrared sensor 6 reaches the control temperature of the infrared sensor 6. The power supply to the heating coil 2 is prevented from being stopped or suppressed based on the detection result of the temperature sensor 7, and the inverter circuit 9 can be controlled based on the infrared sensor 6 having satisfactory heat responsiveness. The heat cooking can be carried out with high heating power. Thus, it is suited to, e.g., stir-frying a food. The heating control can be performed with satisfactory heat responsiveness by using the infrared sensor 6 even with a shape in which detection delay of the temperature easily occurs in the temperature sensor 7 such as a shape in which the bottom of the pan is warped.

The inverter circuit 9 can be controlled by the temperature sensor 7 if the infrared sensor 6 breaks down and the output of the infrared sensor 6 does not reach the predetermined value V since the inverter circuit 9 is controlled using both the output of the temperature sensor 7 and the output of the infrared sensor 6. The temperature sensor 7 thus can operate as a backup for the case in which the infrared sensor 6 breaks down. When judged that the infrared sensor 6 is not normal, the control temperature of the temperature sensor 7 remains at the initial value CT1 that is lower than the CT2, and thus red-heat and oil firing of the cooking container 3 can be prevented and the cooking container 3 can be heated even with the temperature sensor 7 of unsatisfactory heat responsiveness. The safety is thereby ensured.

The control unit 8 sets the control temperature of the temperature sensor 7 high after the elapse of the first predetermined time Δta, and thus the control temperature of the temperature sensor 7 does not become high even if the cooking container 3 is temporarily lifted during heating and disturbance light reaches the infrared sensor 6, and the signal level of the detection signal of the infrared sensor 6 becomes greater than the predetermined value V. Thus, the control temperature of the temperature sensor 7 can be raised while avoiding the case in which the cooking container 3 is temporarily lifted, thereby ensuring the safety of heat cooking.

At the start of heating, when the cooking container 3 is continuously disposed to be shifted from the infrared light incident region 12 of the infrared sensor 6, or when the cooking container 3 is moved after raising the control temperature of the temperature sensor 7, disturbance light reaches the infrared sensor 6 and the output of the infrared sensor 6 may not lower. In this case, the temperature of the cooking container cannot be correctly detected with the infrared sensor 6. According to the present embodiment, the control temperature of the temperature sensor 7 is returned after the elapse of the second predetermined time Δtb from when the control temperature of the temperature sensor 7 is raised, and thus even if, for example, the temperature of the cooking container cannot be correctly detected by the infrared sensor 6 when the cooking container is left in a cooking state due to forgetting of switching OFF a switch, the inverter circuit 9 can be safely controlled based on the output of the temperature sensor 7 after the elapse of the second predetermined time Δtb.

Since the infrared sensor 6 needs to output the detection signal when the temperature is higher than or equal to about 250° C., a silicon photodiode for detecting the temperature only at a high temperature can be used as the light receiving element. The infrared sensor 6 thus can be inexpensively configured.

The temperature distribution of the cooking container 3 is such that the temperature around the middle of the winding portion on the outer side of the center of the heating coil 2 becomes higher than the temperature of the center of the heating coil 2. The temperature of the high temperature portion of the cooking container 3 can be measured by disposing the infrared sensor 6 between the inner coil 2*a* and the outer coil b and measuring the bottom surface portion of the cooking container 3 positioned at an upper part between the windings of the inner coil 2*a* and the outer coil b. Thus, the power supply to the heating coil 2 can be controlled by the infrared sensor 6 with higher detection sensitivity on the high temperature portion of the cooking container 3.

[1.5] Variation

In the present embodiment, the infrared sensor 6 outputs the detection signal when the temperature is higher than or equal to about 250° C. with the illumination lighted, but the value is not limited to 250° C. For instance, the value may be a temperature lower than or a temperature higher than 250° C. Taking into consideration the inexpensive configuration of the infrared sensor 6, a variation of the circuit of the control unit 8, and the like, a temperature within the range from 240° C. to 260° C. is preferable.

In the present embodiment, judgment is made that the infrared sensor 6 is normally detecting the temperature of the cooking container 3 if the signal level of the detection signal outputted from the infrared sensor 6 is within the predetermined range (greater than or equal to the first predetermined value V and smaller than or equal to the second predetermined value W), but the second predetermined value W may not be provided and judgment may be made that the temperature of the cooking container 3 is normally detected if the signal level is greater than or equal to the first predetermined value V. Since whether normally detecting at higher accuracy can be judged by providing the second predetermined value W which is an upper limit value, both the first predetermined value V which is the lower limit value and the second predetermined value W which is the upper limit value are preferably used.

The first predetermined value V that is a reference in judging that the infrared sensor 6 is normally detecting the temperature of the cooking container 3 is a value corresponding to the output of the infrared sensor 6 when the bottom surface temperature of the cooking container 3 detected in a normal state by the infrared sensor 6 is about 260° C., but the first predetermined value V is not limited thereto. The first predetermined value V is used as the lower limit of the judgmental standard in changing the control temperature of the temperature sensor 7 from CT1 to CT2, and thus the first predetermined value V merely needs to be a value at which the heating output suppression control by the temperature sensor 7 is not substantially executed when cooking with high heating power at a high temperature such as stir-frying. For instance, if the control temperature CT1 of the temperature sensor 7 is about 180° C. as in the present embodiment, the first predetermined value V merely needs to be within a range of the detection output value corresponding between 250° C. and 260° C. Similarly, the second predetermined value W is a value corresponding to the output of the infrared sensor 6 when the bottom surface temperature of the cooking container 3 detected in a normal state by the infrared sensor 6 is about 350° C., but is not limited thereto. The second predetermined value W is used as the upper limit of the judgmental standard in changing the control temperature of the temperature sensor 7, and thus merely needs to be a value corresponding to a temperature exceeding the temperature that can be detected as the bottom surface temperature of the cooking container 3 detected in a normal state by the infrared sensor 6. For instance, if the control temperature by the infrared sensor 6 is between about 290° C. and 330° C. as in the present embodiment, the second predetermined value W may be set within a range of the detection output value corresponding between about 350° C. and 400° C.

The first predetermined value V may be changed such that the corresponding detected temperature of the cooking container 3 becomes lower as the detected temperature of the temperature sensor 7 becomes higher based on the bottom surface temperature of the cooking container 3 detected by the temperature sensor 7. The temperature difference between the temperature sensor 7 and the cooking container 3 is assumed to be small when the detected temperature of the temperature sensor 7 is high, and thus the overshoot of the temperature of the cooking container 3 by the control of the temperature sensor 7 is small compared to the case in which the detected temperature of the temperature sensor 7 is low, and the temperature of the cooking container 3 by the temperature sensor 7 does not become excessively high even if the control temperature of the temperature sensor 7 is changed higher at a timing earlier than when the detected temperature of the temperature sensor 7 is low, and thus safety is ensured, and lowering of the heating power can be prevented by the output suppression by the temperature sensor 7. For instance, the first predetermined value V may take a value at the time when the detected temperature of the infrared sensor 6 corresponds to 270° C. if the detected temperature of the temperature sensor 7 is lower than 200° C., and the first predetermined value V may take a value at the time when the detected temperature of the infrared sensor 6 corresponds to 260° if the detected temperature of the temperature sensor 7 is higher than or equal to 200° C.

In the present embodiment, whether or not the output of the infrared sensor 6 is within the predetermined range is judged again when the first predetermined time Δta is reached, but the set value of the first predetermined time Δta may be any value. For instance, the first predetermined time Δta may be zero. If the first predetermined time Δta is zero, the possibility of stopping the heating operation or suppressing the heating output by the control based on the output of the temperature sensor 7 is reduced, whereby the usability is enhanced.

In the present embodiment, whether or not the output of the infrared sensor 6 is within the predetermined value range is monitored until the first predetermined time Δta is elapsed (S505), but such monitoring operation may be omitted, and the operation may be continued. In this case, it may be judged whether or not the output of the infrared sensor 6 is within the predetermined range after the elapse of the first predetermined time Δta, and the step S506 may be executed if the output of the infrared sensor 6 is within the predetermined range, and the process may be return to step S501 if the output of the infrared sensor 6 is not within the predetermined range.

The control temperature of the temperature sensor 7 is returned when the signal level of the detection signal of the infrared sensor 6 returns to a value smaller than the first predetermined value V, but the time from when the level is returned to a value smaller than the first predetermined value V may be counted, and the control temperature of the temperature sensor 7 may be returned when the counted time for the value smaller than the first predetermined value V exceeds a predetermined time. In the present embodiment, the first predetermined value V at the time of raising the control temperature of the temperature sensor 7 and the first predetermined value V at the time of returning the control temperature of the temperature sensor 7 are the same value, but may be set to different values. For instance, the first predetermined value V at the time of returning the control temperature of the temperature sensor 7 may be a value lower than the first predetermined value V at the time of raising the control temperature of the temperature sensor 7.

Figure 6A:
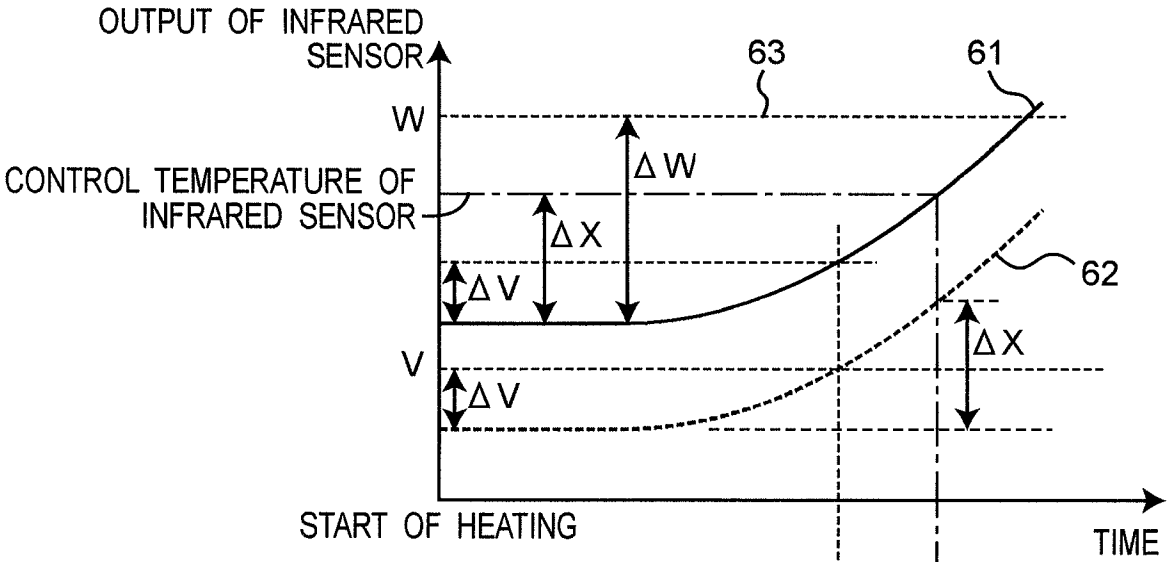
FIGS. 6A and 6B are diagrams showing a relationship between the output of the infrared sensor and the control temperature of the temperature sensor of a variation of the present invention.
Figure 6B:
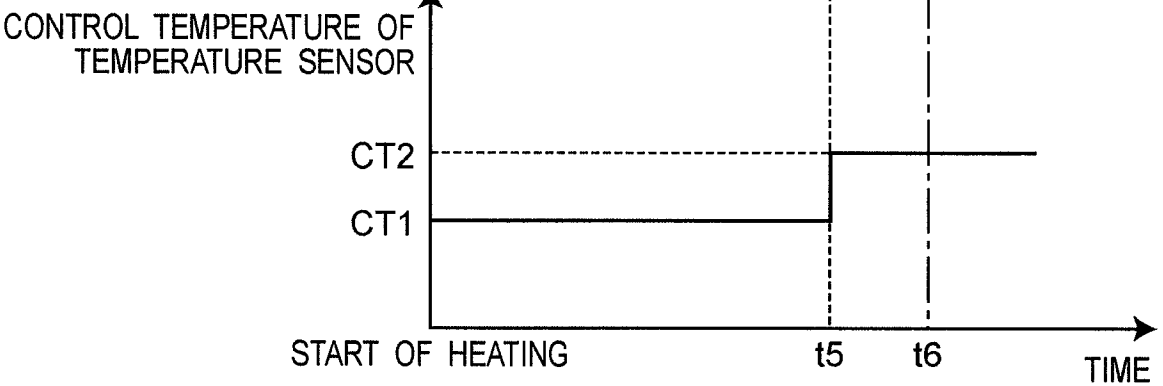
Figure 7:
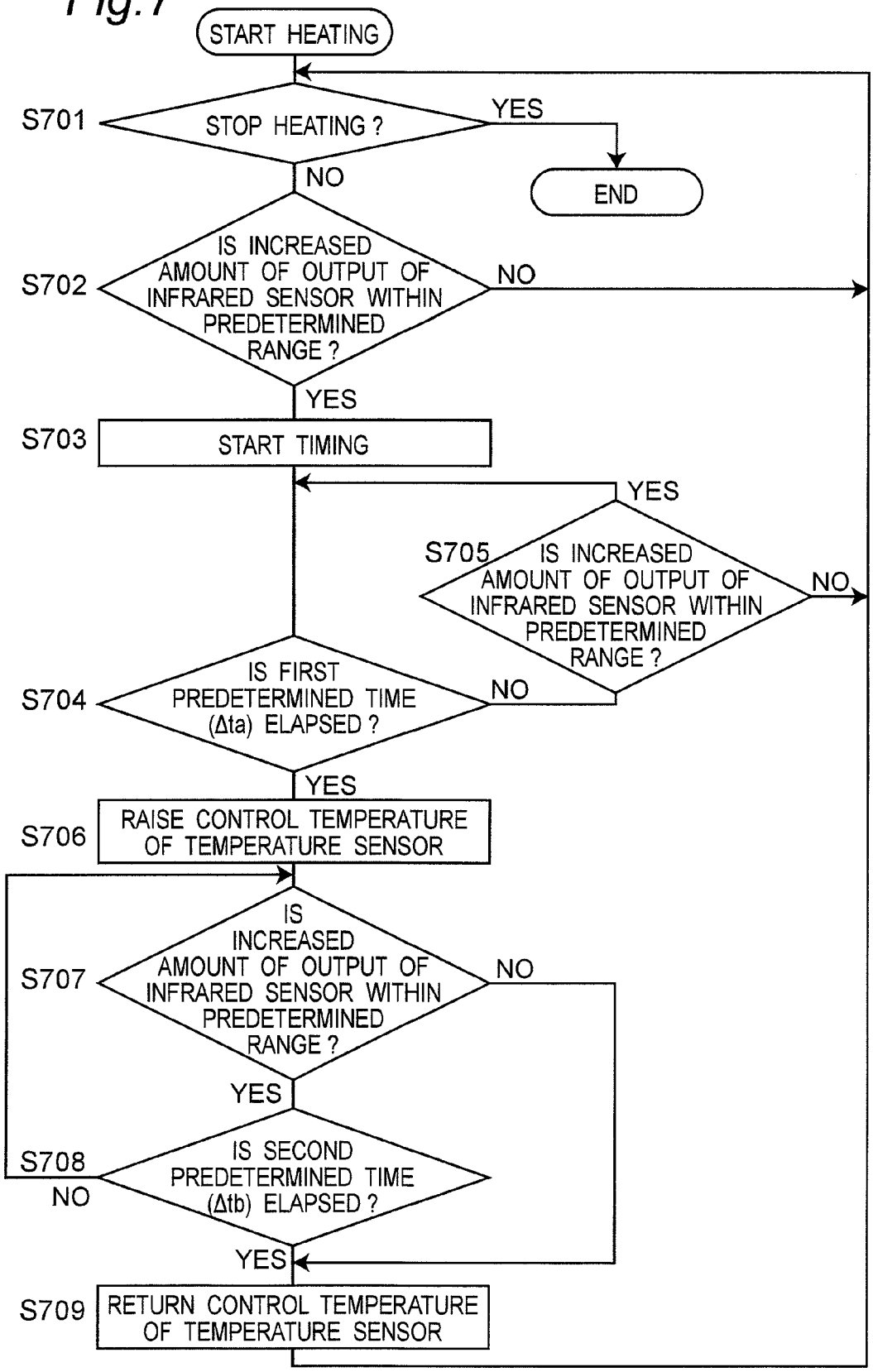
FIG. 7 is a flowchart showing the operation of an induction cooking device of the variation of the present invention.

In the present embodiment, whether the infrared sensor 6 is normally detecting the temperature of the cooking container is judged depending on whether or not the signal level of the detection signal of the infrared sensor 6 is within the predetermined range, but whether normal or not may be judged according to other judgmental standards. FIGS. 6A and 6B show a relationship between the signal level of the detection signal outputted from the infrared sensor 6 and the control temperature of the temperature sensor 7 in the case of raising the control temperature of the temperature sensor 7 according to another judgmental standard, and the horizontal axis in FIGS. 6A and 6B shows the elapsed time from the start of the heating operation. FIG. 7 shows a flowchart corresponding to FIGS. 6A and 6B. FIG. 7 differs from the flowchart of the present embodiment shown in FIG. 5 in that the judgment condition for whether or not the infrared sensor 6 is normally detecting the temperature of the cooking container 3 is "increased amount of the output of the infrared sensor is within predetermined range?" in steps 702, 705, and 707, and that the processing corresponding to step 510 of FIG. 5 is deleted after the processing of step 709, and the processing returns to step 701. In steps 704 to 706, judgment is made that the infrared sensor 6 is normally detecting the temperature of the cooking container 3 when the increased amount of the signal level of the detection signal outputted from the infrared sensor 6 at the current time point with respect to the value of the signal level of the detection signal outputted from the infrared sensor 6 at the time of the start of heating is within a predetermined range (greater than or equal to a predetermined increased amount ΔV and smaller than or equal to a predetermined increased amount ΔW), and the set value of the control temperature of the temperature sensor 7 is changed higher from CT1 to CT2 (time t5), as shown in FIGS. 6A and 6B. For instance, when the signal level of the detection signal 61 becomes greater than that of the normal detection signal 62 due to the influence of disturbance light, the signal level of the detection signal 61 sometimes exceeds the predetermined value V even when the temperature of the cooking container 3 is low. The infrared sensor 6 formed by a silicon photodiode starts to output an output signal when the temperature of the cooking container 3 reaches about 250° C. and the output signal is increased exponentially, and thus in such a case, the control temperature of the infrared sensor 6 for controlling the temperature of the cooking container 3 to a temperature lower than or equal to a predetermined temperature can be set without greatly relying on the temperature of the cooking container 3 at the time of the start of heating by limiting the increased amount of the signal level of the detection signal of the infrared sensor 6 at the current time point with respect to the start of heating to a value within the predetermined range. The time of start of heating includes immediately before the start of heating, at the same time as the start of heating, and immediately after the start of heating. Immediately after the start of heating is preferably within 10 seconds, and more preferably within three seconds, from the start of heating. For instance, in FIGS. 6A and 6B, the control unit 8 judges that the temperature of the cooking container 3 based on the infrared sensor 6 has reached the control temperature of the infrared sensor 6, and stops or reduces the heating output of the heating coil 2 when the increased amount reaches ΔX at time t6. Thus, the influence of disturbance light can be eliminated, and the temperature of the cooking container detected by the infrared sensor 6 can be prevented from exceeding the control temperature of the infrared sensor 6 with a simple configuration by controlling the heating output so that the increased amount of the signal level of the detection signal of the infrared sensor 6 at the current time point with respect to the time of the start of heating does not exceed a predetermined value. If whether or not the infrared sensor 6 is normally detecting the temperature of the cooking container is judged by judging whether or not the increased amount of the signal level of the detection signal of the infrared sensor 6 at the current time point with respect to the time of the start of heating is within the predetermined range, the judgment can be executed with eliminating the influence of disturbance light by using one infrared sensor 6. In this case, the time in which the increased amount of the signal level of the detection signal is at a value greater than or equal to the predetermined increased amount ΔV is counted by the timing unit 10, and the set value of the control temperature of the temperature sensor 7 may be increased after the counted time reaches a time greater than or equal to a predetermined time. Or, the time from when the increased amount of the signal level of the detection signal has reached a value greater than or equal to the predetermined increased amount ΔV may be counted by the timing unit 10, whether the increased amount is greater than or equal to ΔV may again be checked after the counted time reaches a time greater than or equal to the predetermined time, and then the set value of the control temperature of the temperature sensor 7 may be increased.

In the present embodiment, whether or not the infrared sensor 6 is normally measuring the temperature of the cooking container 3 is judged based on the output signal of the infrared sensor 6 during the heating of the cooking container 3 and the control temperature of the temperature sensor 7 is changed, but whether or not the infrared sensor 6 is normally detecting the temperature of the cooking container 3 may be judged before the start of heating of the cooking container 3. For instance, light emitting means such as an LED may be provided in the vicinity of the infrared sensor 6, the light emitting means may be controlled to emit light before the start of heating, whether or not the infrared sensor 6 is normal may be judged based on the output value of the infrared sensor 6, and the changing of the control temperature of the temperature sensor 7 to a high temperature may be prohibited if it is judged that the infrared sensor 6 is not normal. Visible light detection means capable of detecting visible light such as an illuminance sensor may be provided in the vicinity of the infrared sensor 6, and the changing of the control temperature of the temperature sensor 7 to a high temperature may be prohibited when the visible light detection means detects the entry of visible light of greater than or equal to a predetermined amount to the infrared sensor 6. If it is checked that the cooking container 3 is not positioned on the infrared light incident region 12, for example, by applying light on the infrared light incident region 12 from the lower side and measuring the reflected light, the changing of the control temperature of the temperature sensor 7 to a high temperature may be prohibited. Such methods may be combined to set the control temperature of the temperature sensor 7 to a high value CT2 in advance when it may be judged that the infrared sensor 6 is normally measuring the temperature of the cooking container 3 before heating. Whether or not the infrared sensor 6 is normally heating the cooking container 3 may be judged both before heating and during heating. For instance, if it is judged that the infrared sensor 6 is normal before heating, the control temperature of the temperature sensor 7 may be changed when the signal level of the detection signal of the infrared sensor 6 becomes within the predetermined range during heating, and if it is judged that the infrared sensor 6 is abnormal before heating, the control temperature of the temperature sensor 7 may be controlled not to be raised even when the signal level of the detection signal becomes within the predetermined range during heating. A safer and easy-to-use induction cooking device can be provided by judging whether or not the infrared sensor 7 can normally detect the temperature of the cooking container both before heating and during heating. The light emission means for checking the operation of the infrared sensor 6 may illuminate the infrared light incident region 12 or the vicinity thereof so that the incident light region 12 is visible when the cooking container 1 is not placed on the infrared light incident region 12 of the top plate 1. Thus, the user can recognize the position of the infrared sensor 6 and be induced to reliably place the cooking container 3 above the infrared sensor 6. The heating control by the infrared sensor 6 thus can be performed at satisfactory accuracy.

Figures 8A, 8B:
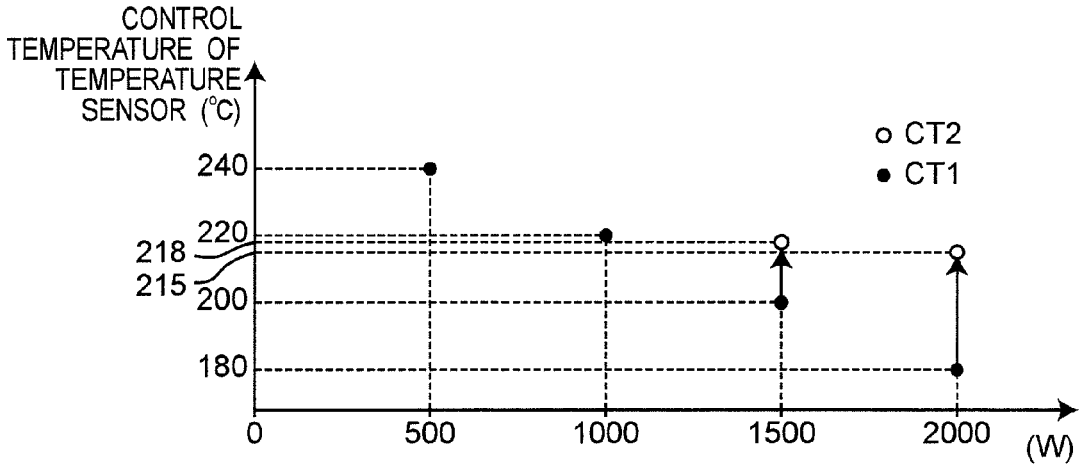
FIGS. 8A and 8B are diagrams showing values before and after a change of the control temperature of the temperature sensor when a plurality of control temperatures of the temperature sensor are provided.

In the present embodiment, the control temperature of the temperature sensor 7 has been described for the set value CT1 in a specific heating power setting, but as shown in FIGS. 8A and 8B, a plurality of set values of the control temperature of the temperature sensor 7 may be provided in advance depending on the intensity of the heating power setting. FIG. 8A shows a table of the control temperature of the temperature sensor 7 corresponding to the plurality of set values of the heating power setting, and FIG. 8B shows a graph of the control temperature of the temperature sensor 7 corresponding to the plurality of set values of the heating power setting. At the time of low heating power, the temperature rise of the cooking container 3 is moderate, and thus the temperature following property is relatively satisfactory and the temperature of the cooking container 3 can be detected even with the temperature sensor 7. Thus, the control temperature at the time of the lower heating power setting is set to a high value in advance compared to the high heating power setting. Thus, the control temperature of the temperature sensor 7 changed based on the output of the infrared sensor 6 may only be the set value corresponding to "3(1500 W)" and "4(2000 W)" of the high heating power setting. In FIG. 8A, when the normal detection of the infrared sensor 6 is checked, the control temperature of the temperature sensor 7 is changed from 200° C. to 218° C. if the heating power setting is "3(1500 W)" and the control temperature of the temperature sensor 7 is changed from 180° C. to 215° C. if the heating power setting is "4(2000 W)". As shown in FIG. 8B, the amount of change of the control temperature of the temperature sensor 7 may not be constant. Since the control temperature of the temperature sensor 7 before the change is set in advance to a lower value in the high heating power setting, the amount of change of the control temperature may be larger in the high heating power setting.

The induction cooking device of the present embodiment uses the heating coil 2 including the division-wound inner coil 2*a* and the outer coil 2*b*, but may use a heating coil that does not have a division-wound configuration. In this case, the temperature of a higher temperature portion of the cooking container 3 can be detected by providing the infrared sensor 6 in the vicinity of the winding of the opening at the center of the heating coil.

In the present embodiment, the temperature sensor 7 is provided on the lower surface of the top plate 1 in the vicinity of the center of the heating coil 2, but may be provided at a position deviating from the center of the heating coil 2. For instance, the temperature sensor 7 may be provided on the lower surface of the top plate 1 positioned between the inner coil 2*a* and the outer coil 2*b* on the side where the infrared sensor 6 is not provided.

In the present embodiment, the infrared light incident region is provided at a portion 12 of the top plate 1. Only the portion 12 corresponding to the infrared light incident region of top plate 1 may be formed of a material capable of transmitting the infrared light and the other portions may be formed of a material not transmitting the infrared light. Or the entire top plate 1 may be formed of a material capable of transmitting the infrared light, and the infrared light incident region 12 may be provided by a print film that transmits the infrared light or by a print removed portion in which the print film is removed, and a print film that does not transmit the infrared light may be provided to the other portions. Thereby, the disturbance light that enters the infrared sensor 6 may be reduced.

The induction cooking device of the present embodiment may also be provided with a display unit configured by an LED or a liquid crystal, or an annunciating unit that outputs a buzzer or voice. The display unit and the annunciating unit notify the user that the infrared sensor 6 is not normally detecting the temperature of the cooking container 3 to enable the user to recognize whether it is in a state that the user can safely use the device, whereby the safe and easy-to-use induction cooking device can be implemented.

INDUSTRIAL APPLICABILITY

The induction cooking device of the present invention has an effect of achieving high heating power at the time of high temperature cooking while ensuring safety, and is useful as an induction cooking device used in general household and the like.

The invention claimed is:

1. An induction cooking device comprising:

a top plate;

a heating coil operable to perform induction heating of a cooking container placed on the top plate;

an inverter circuit operable to supply high frequency current to the heating coil;

an infrared sensor that is provided on a lower side of the top plate to detect an amount of infrared light radiated from the cooking container and output a detection signal based on the detected amount of the infrared light;

a temperature sensor operable to detect a temperature of the cooking container by thermal conduction through the top plate; and a control unit operable to control the high frequency current output from the inverter circuit, such that a temperature indicated by the detected amount of the infrared light radiated from the cooking container does not exceed a first control temperature set for the infrared sensor and such that the detected temperature of the cooking container does not exceed a second control temperature set for the temperature sensor, wherein the control unit judges whether or not the infrared sensor is normally detecting the amount of the infrared light radiated from the cooking container based on the detection signal output from the infrared sensor, and wherein, when the control unit judges that the infrared sensor is normally detecting the amount of the infrared light radiated from the cooking container, the control unit changes the second control temperature to a higher temperature compared to a set second control temperature that is set when the control unit judges that the infrared sensor is not normally detecting the amount of the infrared light radiated from the cooking container.

2. The induction cooking device according to claim 1, further comprising a timing unit operable to count a time from when the control unit judges that the infrared sensor is normally detecting the amount of the infrared light radiated from the cooking container, wherein the control unit again judges whether or not the infrared sensor is normally detecting the amount of the infrared light radiated from the cooking container after an elapse of a predetermined time or more from the time when the control unit judges that the infrared sensor is normally detecting the amount of the infrared light radiated from the cooking container, and when, after the elapse of the predetermined time or more, the control unit judges that the infrared sensor is normally detecting the amount of the infrared light radiated from the cooking container, the control unit changes the second control temperature to the higher temperature.

3. The induction cooking device according to claim 1, wherein the control unit returns the second control temperature to an original temperature at a predetermined timing after changing the second control temperature to the higher temperature.

4. The induction cooking device according to claim 3, wherein the predetermined timing is a time when the control unit judges that the infrared sensor is not normally detecting the amount of the infrared light radiated from the cooking container based on the detection signal output from the infrared sensor after changing the second control temperature to the higher temperature.

5. The induction cooking device according to claim 3, wherein the predetermined timing is a time after a predetermined time has elapsed from when the control unit judges that the infrared sensor is not normally detecting the amount of the infrared light radiated from the cooking container based on the detection signal output from the infrared sensor after changing the second control temperature to the higher temperature.

6. The induction cooking device according to claim 3, wherein the predetermined timing is a time after an elapse of a predetermined time or more from when the control unit changes the second control temperature to the higher temperature.

7. The induction cooking device according to claim 1, wherein the control unit judges that the infrared sensor is normally detecting the amount of the infrared light radiated from the cooking container when the detection signal output from the infrared sensor is within a predetermined range.

8. The induction cooking device according to claim 1, wherein the infrared sensor includes a photodiode made of silicon as an infrared detection element, and wherein the control unit judges that the infrared sensor is normally detecting the amount of the infrared light radiated from the cooking container when an increased amount of the detection signal output of the infrared sensor, with respect to an amount of the detection signal output from the infrared sensor at a time of a start of heating, is within a predetermined range.

9. The induction cooking device according to claim 1, wherein a plurality of set values of the second control temperature is provided, such that each of the set values corresponds to a magnitude of the high frequency current output from the inverter circuit, and wherein the control unit changes only the set value of the second control temperature corresponding to the magnitude of the high frequency current output from the inverter circuit that is greater than or equal to a predetermined value, based on the judgment of whether or not the infrared sensor is normally detecting the amount of the infrared light radiated from the cooking container.

* * * * *